US005341832A

United States Patent [19]

Foust

[11] Patent Number: 5,341,832

[45] Date of Patent: Aug. 30, 1994

[54] DEVICE AND METHOD FOR THE COMBUSTION OF WASTE OIL

[76] Inventor: Harry D. Foust, 1190 CTH 6, LaCrescent, Minn. 55947

[21] Appl. No.: 947,754

[22] Filed: Sep. 21, 1992

Related U.S. Application Data

[63] Continuation-in-part of Ser. No. 695,438, May 3, 1991, Pat. No. 5,149,260, which is a continuation of Ser. No. 345,953, May 1, 1989, abandoned.

[51] Int. Cl.[5] ..... B01D 19/00

[52] U.S. Cl. ..... 137/202; 96/165; 96/194; 96/204; 210/123; 210/188; 210/472

[58] Field of Search ..... 95/248, 260; 96/165, 96/194, 204; 137/202, 549; 210/123, 188, 436, 472

[56] References Cited

U.S. PATENT DOCUMENTS

| | | | |
|---|---|---|---|
| 2,206,358 | 7/1940 | Koinzan | 210/188 X |
| 2,252,687 | 8/1944 | Bassett | 137/202 |
| 2,929,503 | 3/1960 | Ambruster et al. | 137/202 X |
| 3,000,467 | 9/1961 | Bowers | 210/472 X |

OTHER PUBLICATIONS

Advertisement; "Tiger Loop", 2 pages A & A Sales 11-17 Linden St., Passaic, N.J. 07055.

*Primary Examiner*—Gerald A. Michalsky
*Attorney, Agent, or Firm*—Sten Erik Hakanson

[57] ABSTRACT

The present invention concerns a device sequence for burning waste oil and includes a circulating system having a pump for circulating the oil therein and a heater for heating the oil to a suitable combustion temperature during this circulation. A combustion oil system is included for diverting a portion of the circulating oil to an atomizing gun for combination therein with a source of atomizing air. The air and oil mixture is injected through an injection orifice into a suitable combustion chamber for ignition and burning therein. A linear actuator is included having a rod with a needle end that is operated by the actuator in a linear manner along the central axis of the atomizing gun for extending through the injection orifice for providing mechanical cleaning thereof and for regulating oil flow there through.

4 Claims, 12 Drawing Sheets

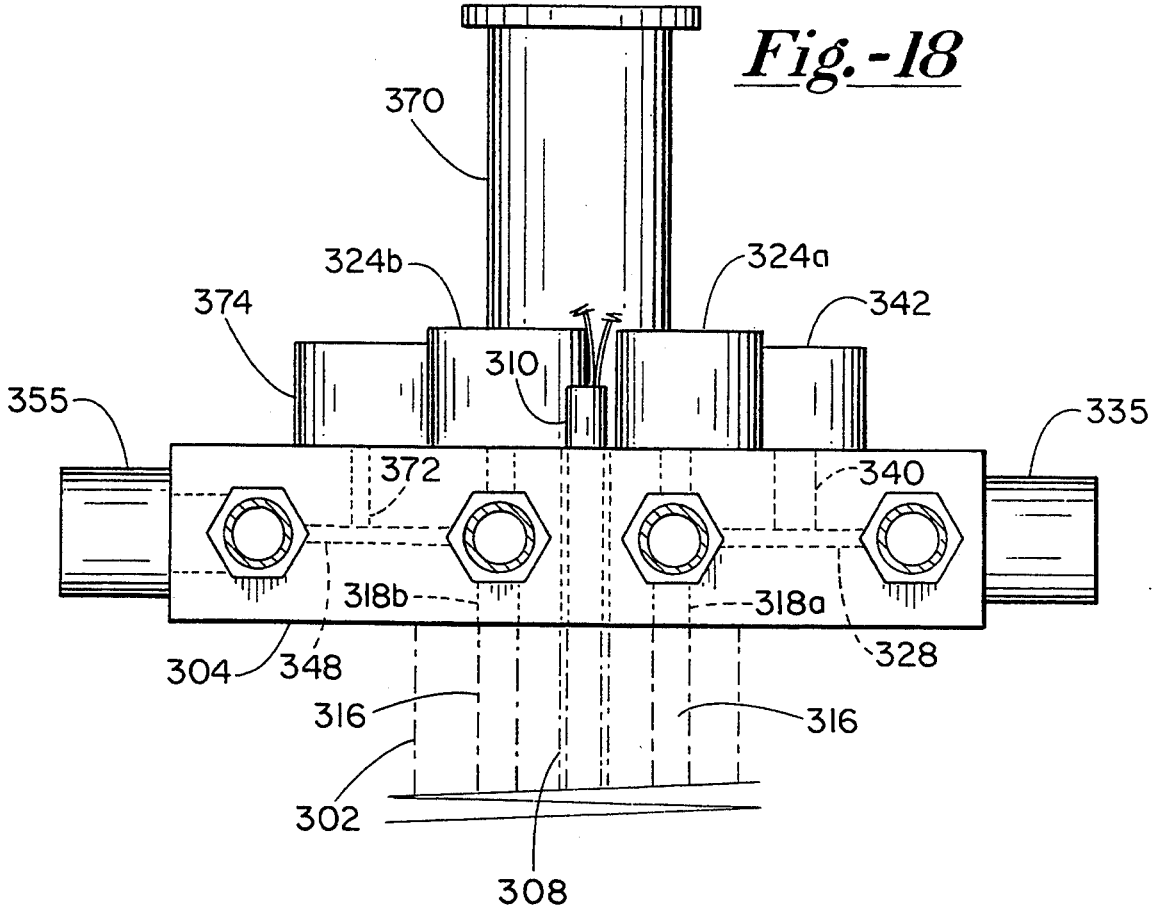
Fig.-18
Fig.-19
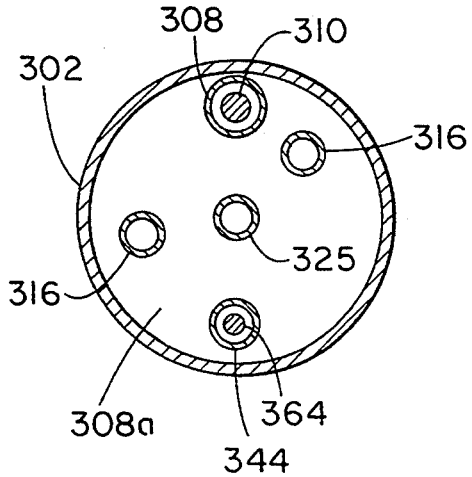

400

420
418
416
402
412
414
422
410
409
430
408
424
426
428
406
404
429
405

214
FAN
210
FAN/LIMIT
THERMOSTAT
120V
R
B
212
C
500
36
FLAME SENSOR
C
F
16
L1
L2
222
9
R
18
IGN TRANS
S
5
6
3
8
COMB MOTOR
240
232
A
C
230
346
310
A
C
MODULE
SAFETY
GROUND
162
DIRTY
FILTER
AIR
PROOF
202
186
OIL SOLENOID
AIR SOLENOID
198
304

DEVICE AND METHOD FOR THE COMBUSTION OF WASTE OIL

The present application is a co-pending continuation-in-part based upon U.S. Ser. No. 07/695,438, filed May 3, 1991, now U.S. Pat. No. 5,149,260, which was a co-pending continuation of U.S. Ser. No. 07/345,953 filed May 1, 1989, now abandoned.

BACKGROUND OF THE INVENTION

1. Field of the invention

The present invention relates generally to heating devices that utilize waste oil as fuel, and more particularly to such heating devices that use waste oil as a sole fuel source, that pre-heat the waste oil prior to burning and that mix the oil with pressurized air prior to combustion thereof.

2. Background

Combustion of waste oil, and in particular drain oil as is generated by automotive and other internal combustion engines, is considered a highly desirable means of disposal of such used lubricants. Efficient combustion promises the generation of heat energy for space heating and the safe elimination of a substance considered hazardous by the United States Environmental Protection Agency. Thus, various heaters or furnaces having the ability to burn waste oil have been proposed. However, the successful combustion of waste oil, such as drain oil, presents formidable hurdles. In particular, waste lubricants contains a wide variety of contaminants, such as, unburned fuel, water, acids, and particulate matter, such as, road dirt and dust, and metal particles resulting from engine wear. These impurities can result in the clogging of standard oil furnace burning nozzles and in the production of non-flammable gasses, both of which occurrences can stop combustion. In addition, waste automotive oil is of a high viscosity as compared with standard fuel oil, thus, it is more difficult to inject into a combustion chamber from a nozzle as a fine well aerated spray.

Initial attempts at burning waste oil involved increasing the pumping force applied to the oil to compensate for its increased viscosity, however, the force needed was very high, and the small nozzle apertures would ultimately become clogged. Other efforts involving simply increasing the nozzle aperture would result in reduced clogging, but would also greatly reduce combustion efficiency as the oil would not be atomized sufficiently. Current art waste oil burners, as seen generally in U.S. Pat. Nos. 4,162,887 to Grey, 4,249,885 to Reich and 4,487,571 to Robertson et. al., include the use of electrical heaters in the oil storage tank or fuel lines thereof to reduce oil viscosity, and filters to remove particulate matter. Also, this prior art shows the use of nozzles, such as made by Delavan, Inc., wherein compressed air is introduced within the nozzle and which mixes with the oil in a circumferential or swirling motion just prior to injection of the oil into the combustion chamber. This compressed air serves to better aerate and atomize the oil as well as resist blockage of the nozzle aperture. The prior art also describes the use of a second source of compressed air exterior of the nozzle to provide for combustion of the oil, as the atomizing oil is not sufficient for this purpose. In addition, as seen in French patent No. 75 05928 to Poirier, heated waste oil can be circulated through the gun prior to combustion so that the oil and gun first reach optimal temperature to insure proper fluidity of the oil.

However, current art waste oil burners continue to be plagued by the problem of flame outage. Such outage, and thus, burner unit shut down, is primarily the result of nozzle orifice blockage by particulate matter or agglomeration of the oil, or as the result of essentially inflammable gasses being periodically ejected from the nozzle in place of the oil. Thus, the reliability of such systems is quite low as they require frequent cleaning and repair. Therefore, such systems can not be left unattended without a back-up heating system.

Accordingly, it would be highly desirable to have a heating system capable of burning waste oil in a manner that is efficient and reliable.

SUMMARY OF THE INVENTION

The objects of the present invention include, but are not limited to, the following:

1. To provide for the burning of waste oil in a manner that is energy efficient.
2. To provide for such burning in a manner that is reliable, and in particular is resistant to interruption or shut-down due to particulate formation and the production of gas.
3. To provide for the mechanical removal of any particulate or other blockage of the oil injection orifice.
4. To provide for the safe burning of waste oil.
5. To provide for the removal of gases given off by the oil prior to the combustion thereof.

The method and apparatus of the present invention concerns a waste oil burning device, a control system therefor, and a modified oil atomizing nozzle. The present invention can be broadly viewed as including an oil circulating system, an oil injecting system and a control system.

The oil circulating system includes a tubular network in connection with a reservoir or waste oil source, that includes a pump, heating means for reducing the viscosity of the oil, and a filter located downstream of the heater with respect to the direction of flow of the oil. The circulatory system also includes a re-circulating oil supply, return lines, a combustion oil supply line, and a variety of sensing and valve means.

The injecting or atomizing system includes an atomizing gun for injecting the oil into a suitable combustion chamber. The gun includes an atomizing nozzle secured to one end of an elongate gun body portion, and a linear actuating means secured to the opposite end of the gun body. The atomizing nozzle includes an oil injection orifice and means for delivering compressed atomizing air in a circumferential manner about the oil orifice. Supply and return orifices on the gun body are connected to the supply and return lines respectively of the circulatory system md provide for circulating of the oil within a circulatory pathway of the body portion. A small diameter atomizing air passage extends through the gun body and provides for the delivery of air to the nozzle. A second small diameter combustion oil delivery passage extends centrally of the gun body portion and along the axis thereof, for providing fluid communication of the combustion oil to the nozzle. A cleaning pin extends down the center of the second passage and through the center of the nozzle terminating with a tip end adjacent the oil orifice. The opposite end of the pin extends through the combustion oil passage and is connected to the linear actuating means.

The atomizing system also includes a motor for operating a blower for supplying combustion air adjacent the exterior of the combustion oil orifice. The motor is also connected to the pump of the oil circulating and injecting systems to provide for flow of oil there through. The atomizing system further includes a variety of control and sensing means for regulating the oil flow and ignition.

The control system includes a plurality of relays, electronic control devices, and the like, and the necessary circuitry for connecting such devices with the control and sensing means of the delivery and atomizing systems. The operation of the present invention, as regulated by the control system, can be viewed as including four separate steps; off, pre-heat, burn, and post-burn cool down. Thus, the system is initially off until a thermostat in the space to be heated signals for the delivery of heat. The motor is then started thereby operating the pump and the blower. In particular, the oil first flows past the heater then through the filter after which it travels through the supply line and into the circulating pathway of the body portion of the atomizing gun. The oil then flows along the length of the tubular body of the atomizing gun and returns to the circulatory system via the return line to repeat the above described pathway. This closed loop circulation continues until the circulating oil and atomizing gun and nozzle, by conduction from the heated oil, reach the desired temperature range of 140 to 200 degrees Fahrenheit. In an alternate embodiment of the atomizing gun the heater is located therein and the filter is combined with an air vapor eliminator and located downstream of the gun in the circulatory system. The vapor eliminator sits atop the filter and includes a float chamber, having a float therein, in fluid communication with an inlet from the circulatory system. The inlet includes a venturi that creates an area of lower pressure that removes oil from the chamber in a direction towards the filter to be combined with the flow from the circulatory system inlet. The oil then passes through the filter element and then through an outlet back to the circulatory system for diversion to the gun or further circulation. A further channel exists between the filter element at a top end thereof and the float chamber. A circulation is created by the venturi wherein any gas at the top of the filter will be sucked into the float chamber through this second channel to replace any oil removed therefrom. This gas will cause the float to drop and unseat from a vent aperture through which the gas can be vented to the atmosphere.

In either gun embodiment, after the oil is at a suitable temperature for combustion a portion thereof can be directed from the closed loop into the combustion oil supply line, at which time the linear actuator withdraws the pin from the nozzle orifice. The combustion oil is then fed into the atomizing gun body and through the center thereof by the small diameter combustion oil passage to the atomizing nozzle to be mixed with the atomizing air and ultimately injected into the combustion chamber, ignited and burned. Thus, a portion of the circulating oil is periodically removed for combustion from the circulatory system as is required, whereby such diversion is achieved by the use of a solenoid valve operated by the control system. In addition, the oil in the circulatory system and in the atomizing gun up to the point that it is injected into the combustion chamber, is maintained at a positive essentially constant pressure selected from a range of generally between 10 to 30 psi.

When the thermostat in the heated space signals that the desired temperature has been reached combustion can then be stopped. In the present invention the solenoid valve controlling the diversion of oil from the closed loop circulation network is closed, the atomizing air is shut off and the oil heater is turned off. The linear actuator is simultaneously activated causing the pin to be inserted into the nozzle orifice resulting in the closure thereof. However, the pump continues to operate circulating oil through the closed loop network, including the nozzle body portion. This circulation is continued until the atomizing nozzle, and, in particular, the atomizing end thereof, cools, again by conduction to the now cooling oil, to a pre-set temperature, after which the pump is turned off.

A major advantage of the present invention concerns the closed loop circulatory system. Applicant herein recognized that localized heating of waste oil can cause the precipitation of particles sufficient to block the oil injection orifice. Thus, the continuous circulation of oil serves to reduce any such localized heating of oil and the resultant precipitate formation. Also, the filter is located downstream of the heater with respect to the direction of oil flow, and thereby provides additional means for eliminating unwanted particles that may otherwise form in the vicinity of the heater, as well as to remove any particles already present therein. It can also be seen that the circulation of oil in the tubular body of the atomizing gun at start-up, but prior to combustion, serves to warm the atomizing gun and any residual oil therein remaining from the previous firing. As waste oil must be heated before it will bum properly, a remote heat source, as seen in the prior art, will not serve to heat such residual oil in the gun. Therefore, this residual oil can be too viscous or cold to be properly atomized and ignited resulting in false starts and shut downs.

It can also be understood that the circulatory system provides for cooling of the atomizing gun during post-burn shut down. The prior art failed to appreciate the deleterious heat effects on the atomizing gun and the oil therein after combustion is stopped. In particular, after combustion there exists a heat-soak effect wherein the residual heat in the combustion chamber is conducted to the atomizing gun causing precipitate or tar formation of the oil therein resulting in blockage of the oil injecting orifice. In addition, such residual heat can cause the oil in the final delivery circuit to produce gas which can cause the oil to ooze from the oil orifice and create a vapor lock. Both situations can result in false starts and shut-downs. Thus, the circulating of the oil after shut-down of combustion, and particularly of the oil heater, allows the cooling of the atomizing gun by drawing off such latent heat.

A further advantage of the present invention concerns the maintaining of the oil in the circulatory system and the atomizing nozzle up to the point of injection at a pressure above atmospheric. Waste oil has the tendency to produce an essentially inflammable gas, particularly when heated. Prior art waste oil burning devices leave the oil at atmospheric pressure in the atomizing gun, and in some cases below atmospheric, as the result of siphoning of the oil into the gun from a reservoir source. As a result thereof, the production of gas is not inhibited, and in the case of siphoning delivery, is enhanced. Production of such inflammable gas can result in flame outage and shut-down. In the present invention the oil is pressurized to reduce this gas production to a level that does not have a substantial effect on the performance thereof. In the alternate embodiment, a further strategy for the elimination of inflammable gas outage problems concerns the use of the vapor eliminator. This device permits the elimination of such gasses from the circulatory system prior to any diversion of oil therefrom to the atomizing gun for combustion.

A further advantage of the present invention concerns the use of a linear actuator. The cycling of the pin in and out of the oil orifice allows for a mechanical means for removing from the oil orifice any particles that may nevertheless form h spite of the other steps and precautions taken in the present invention to prevent such blockage. In addition, opening and closing the oil orifice serves to prevent oil leakage after shut-down and to maintain pressure. The pin also provides a positive safety element by mechanically closing the oil orifice at shut-down.

BRIEF DESCRIPTION OF THE DRAWINGS

Further objects and advantages of the present invention can be had in view of the following detailed description of the present invention which refers to the following figures, wherein:

FIG. 18 shows a top view along lines 18—18 of FIG. 16.

FIG. 19 shows a cross-sectional view along lines 19—19 of FIG. 15.

DETAILED DESCRIPTION

Figure 1:
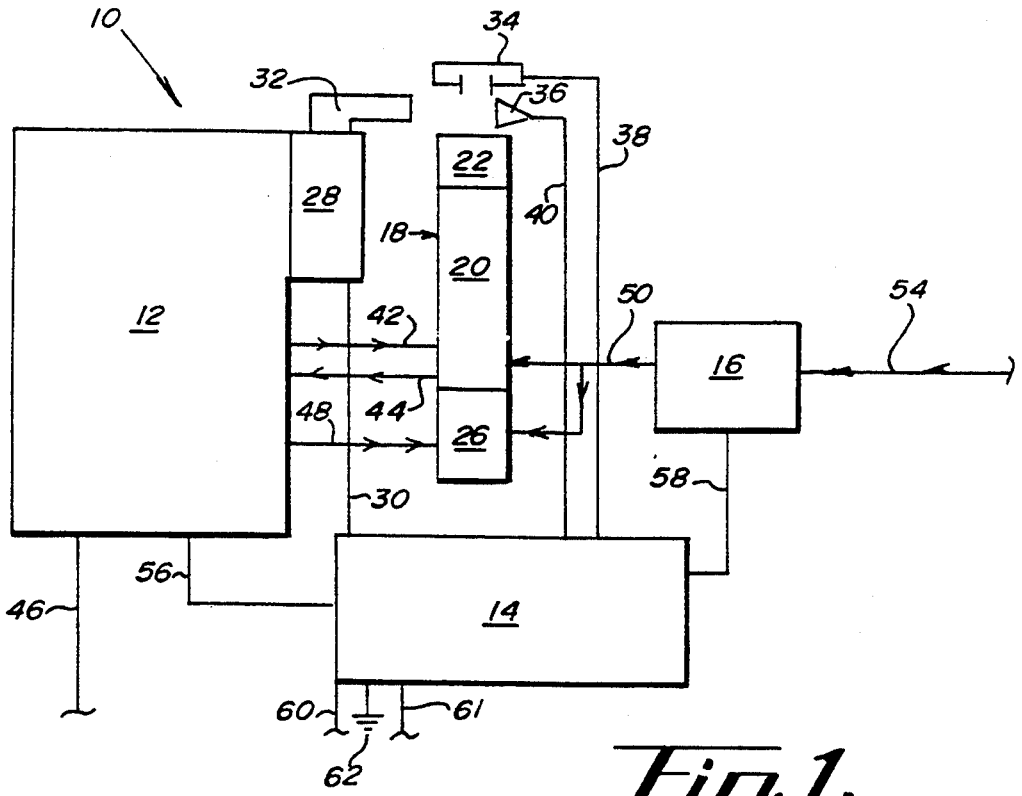
FIG. 1 shows a block diagram representation of the present invention.

The oil combustion system of the present invention is schematically represented in FIG. 1 and generally referred to as number 10. Combustion system 10 includes a hydraulic system 12, a control system 14 and a pneumatic system 16. The present invention also includes an oil atomizing gun 18 which includes a rectangular heat exchanging oil circulating body 20, and an oil atomizing nozzle portion 22 secured to one end of body 20. A linear actuating means 26 is secured to body 20 on an end thereof opposite from nozzle 22. An electrically operated blower 28 is connected by electrical line 30 to control system 14, and includes an air conduit means 32 for directing combustion air adjacent the immediate exterior of nozzle end 22 of gun 18. An electronic ignition means 34 and a flame sensing means 36 are electrically connected to control system 14 by lines 38 and 40 respectively. Hydraulic system 12 is fluidly connected by a circulating oil supply line 42 and a circulating oil return line 44 to body 20, and to a fuel oil reservoir or tank, (not shown), by fuel supply line 46. Hydraulic system 12 is also fluidly connected to actuating means 26 by a combustion oil supply line 48.

Pneumatic system 16 is connected by a compressed air line 50 to body 20 and to linear actuator 26 and is connected to a source of compressed air, (not shown), by a compressed air supply line 54. As will be described in greater detail below, hydraulic system 12 and pneumatic system 16 include a variety of sensing and regulating means each of which is connected to control system 14 by separate electrical connections, which connections in FIG. 1 are cumulatively represented by lines 56 and 58 respectively. Control system 14 is connected to a conventional 120 volt fused/disconnect source of alternating current by lines 60 and 61, and to a ground 62.

Figure 9:
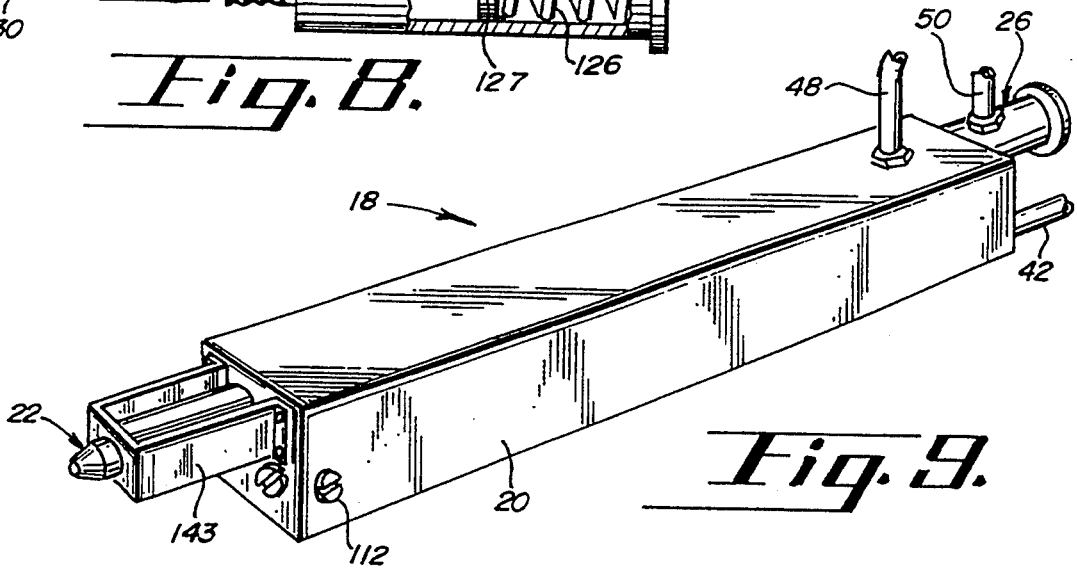
FIG. 9 shows a perspective view of the atomizing gun of the present invention.

Referring to FIG. 9, it can be seen that atomizing gun body 20 is rectangular having nozzle assembly 22 secured to one end thereof. Actuator 26 is secured to body 20 on the end thereof opposite from nozzle 22.

Figure 4:
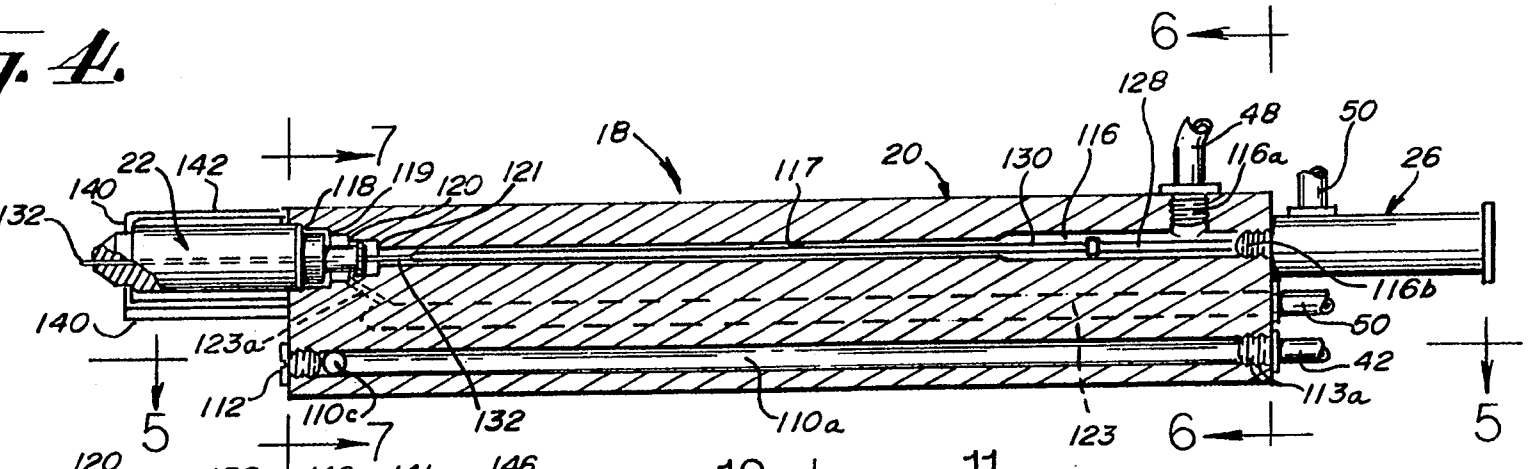
FIG. 4 shows a side plan view with portions cut away of the atomizing gun of the present invention.
Figure 10:
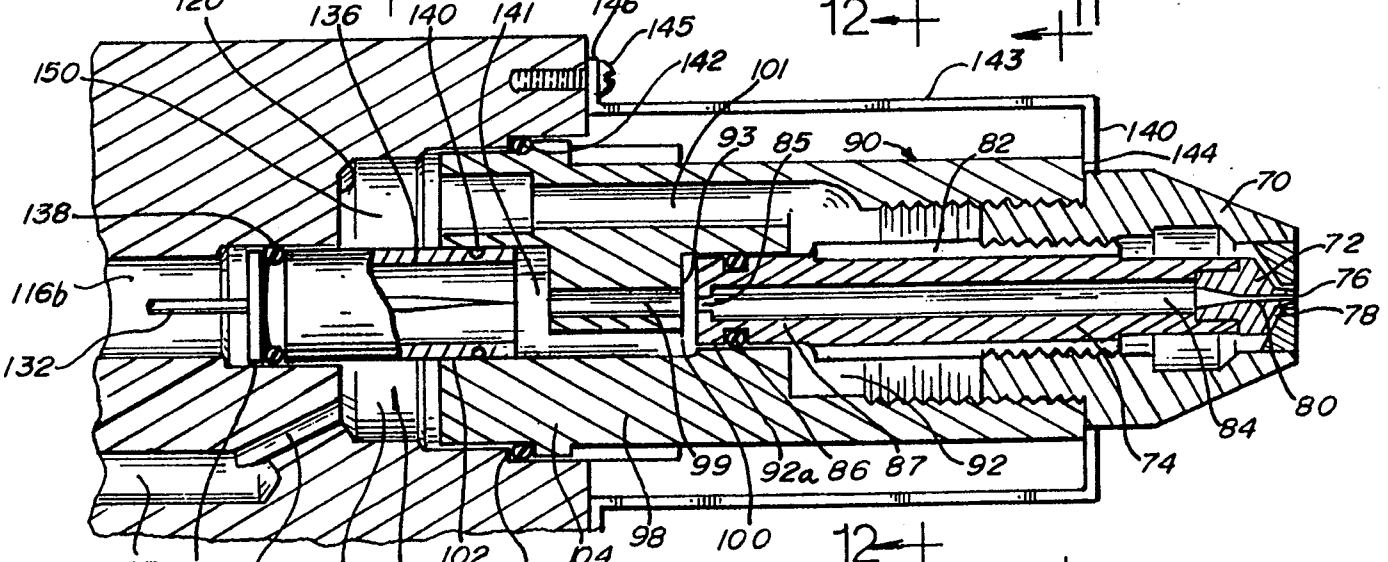
FIG. 10 shows an enlarged cross-sectional view of the atomizing nozzle of FIG. 4.
Figure 5:
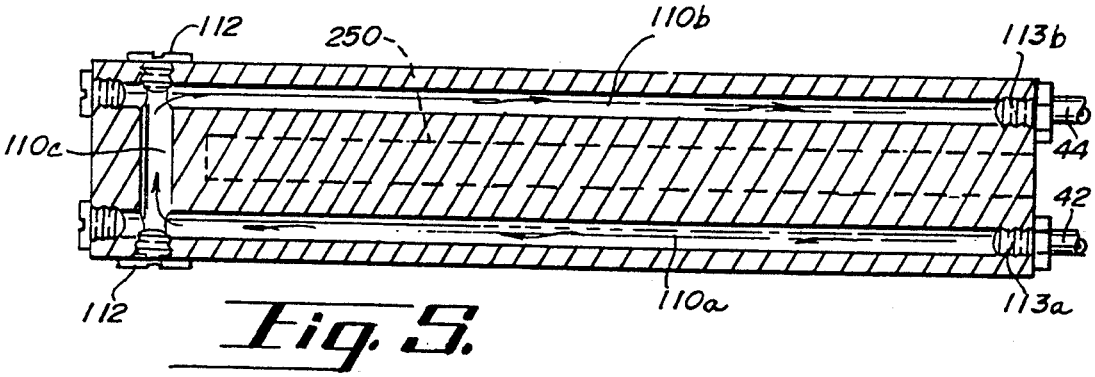
FIG. 5 shows a top plan view of the gun body along lines 5—5 of FIG. 4.

Referring to FIG. 10, nozzle assembly 22 can be understood by those of skill in the art to represent a modified nozzle of the Delavan type. The conventional components thereof include a nozzle end cap 70, an air swirl insert 72 and an internal fitting 74. As is known in the art, nozzle end cap 70 includes a central oil injection aperture 76, and insert 72 includes a plurality of air swirl channels 78 and a central oil aperture 80. As is also known, internal fitting 74 includes longitudinal ridges 82 projecting from the central surface thereof, a central oil delivery channel 84, an oil orifice 85 and an o-ring 86 extending around a reduced diameter end 87. Nozzle end cap 70 is shown in FIG. 4 threadably engaged with internal fitting 74 with insert 72 there between. As is also understood by those of skill, when internal fitting 74 is so engaged with nozzle end cap 70, air can flow through channels 78 towards injection orifice 76.

Figure 13:
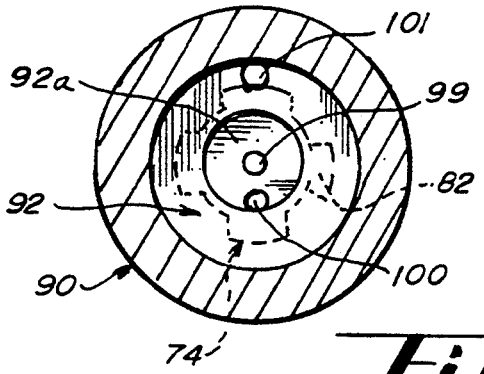
FIG. 13 shows a cross-sectional view of the atomizing nozzle body along lines 13—13 of FIG. 4 with the internal nozzle fitting indicated in ghost outline.
Figure 12:
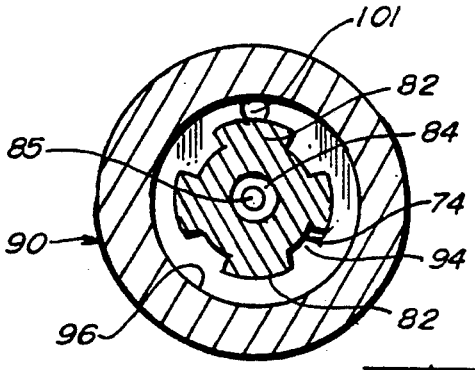
FIG. 12 shows a cross-sectional view of the atomizing nozzle body and internal nozzle fitting along lines 11—11 of FIG. 4.
Figure 11:
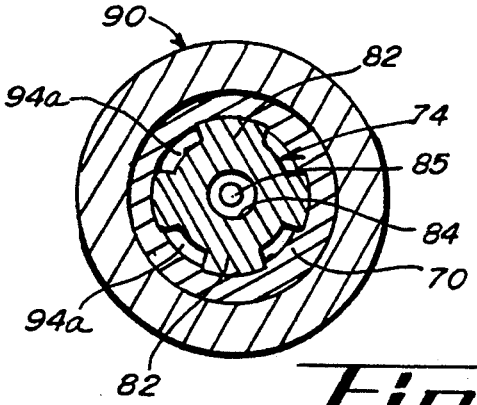
FIG. 11 shows a cross-sectional view of the atomizing nozzle body and internal nozzle fitting along lines 11—11 of FIG. 4.
Figure 14:
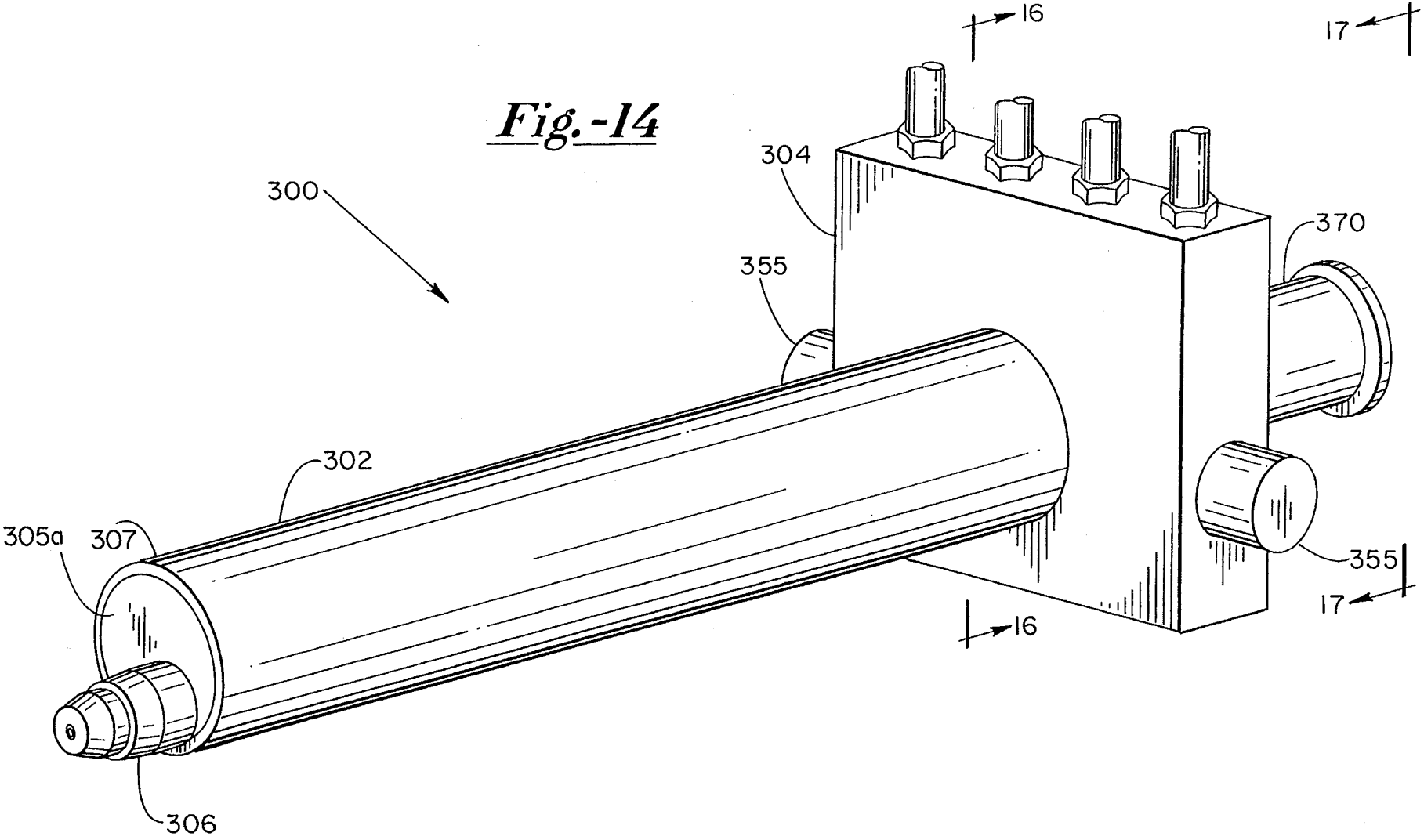
FIG. 14 shows a perspective view of an alternate embodiment of the injection gun of the present invention.

End 70 and fitting 74 are in turn threadably engaged with a modified nozzle body 90. As seen by also referring to FIGS. 11, 12 and 13, nozzle body 90 includes a cavity 92 and a cavity recessed portion 92*a* for receiving internal fitting 74. Specifically, end 87 extends partially into recess 92*a* in a sealing manner with o-ring 86 creating an oil flow space 93. Moreover, an atomizing air flow channel 94 is then defined between internal fitting 74 and the interior surface 95 of cavity 92. Particularly referring to FIG. 11, as is known in the art, air passage 94 communicates with air channels 94*a* formed between ridges 82 and the interior surface of end cap 70. An orifice 96 extends through an end of fitting 74 and communicates with oil flow channel 84 extending through the center thereof. It will be appreciated that insert 72 extends partially into channel 84 at the end thereof opposite from orifice 96. Base end 98 of body 90 includes a central needle guide channel 99, a combustion oil channel 100 and an atomizing air channel 101 extending there through. End 98 also includes a recess 102 extending therein in a direction opposite from that of recess 92*a*, and an annular lip 104 around the exterior thereof.

Referring now to FIGS. 4, 5, 6, and 7, it can be seen that gun body 20 is a rectangular elongate block, preferably of a metallic material, such as aluminum, into which a variety of bores or passages have been drilled. Specifically, body 20 includes a U-shaped circulatory oil loop consisting primarily of two passages 110*a* and 110*b* displaced from each other in a common horizontal plane and extending substantially the length of body 20 and in fluid communication with each other through a short passage 110*c*. It will be understood by those of skill that plugs 112 provide for the blocking of orifices necessitated by the drilling of bores 110*a*, 110*b*, and 110*c*. Passages 110*a* and 110*b* terminate with threaded ends 113*a* and 113*b* for providing connection to circulating oil supply conduit 42 and circulating oil return conduit 44, respectively. A combustion oil delivery passage consists primarily of a first large diameter portion 116 in fluid communication with a second smaller diameter portion 117. Large diameter passage 116 includes a threaded opening 116*a* for coupling with combustion oil supply line 48, and an opening 116*b* for providing threaded engagement of pneumatic linear actuator 26 with body 20. Portion 116 is in fluid communication with a nozzle receiving recess, generally designated 118, including annular shoulders 119, 120, and 121. An atomizing air passage 123 extends along the length of and within body 20. Passage 123 is connected on one end with pressurized air supply conduit 50 and, includes an angled reduced diameter channel portion 123*a* on its other end extending to and terminating on annular shoulder 126 for providing air communication thereto.

Figure 8:
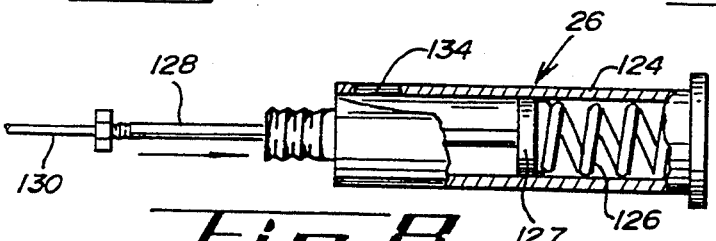
FIG. 8 shows a partial cross-sectional view of the linear actuator of the present invention.

As seen in FIG. 8, actuator 26 is an air pressure activated type, of the type, as for example made by Incore International, Inc., of Quincy, Mass., and includes an outer housing 124 enclosing a spring 126 and a piston 127 connected to a piston rod 128. Rod 128 extends through a gland, not shown, in housing 124, and into large passage I 16, and terminates therein. An actuating rod 130 is threadably connected to piston rod 128 and extends through small diameter passage 117, and is, in turn, secured to an oil orifice needle 132. Needle 132 extends into nozzle 22 and terminates therein adjacent oil injection aperture 76. Actuator 26 includes a threaded opening 134 for providing coupling to compressed air supply conduit 50.

A more complete understanding of the manner of attachment and interaction of nozzle 22 and gun body 20 can now be had. As seen in FIG. 10, nozzle end 98 is inserted into recess 118 wherein there exists a tube or gland 136. One end of tube 136 extends into recess 118 adjacent shoulder 121 and is held therein in sealing engagement by o-ring 138. The opposite end of tube 136 is inserted partially into recess 102 and is held in sealing engagement therein by a second o-ring 140, creating an oil space 14 1. Nozzle 22 is in sealing engagement with recess 118 by o-ring 142 being pressed between annular shoulder 119 and annular lip 104. Nozzle 22 is secured to body 20 by a bracket 143 engaged with nozzle end shoulder 144, and secured to body 20 by a plurality of screws 145 extending through bracket feet 146 and into threaded holes 148. It can be appreciated that nozzle end 98 terminates adjacent shoulder 120 and defines an air space 150 providing communication between atomizing air channel 123*a* and atomizing air channel 101.

Figure 2:
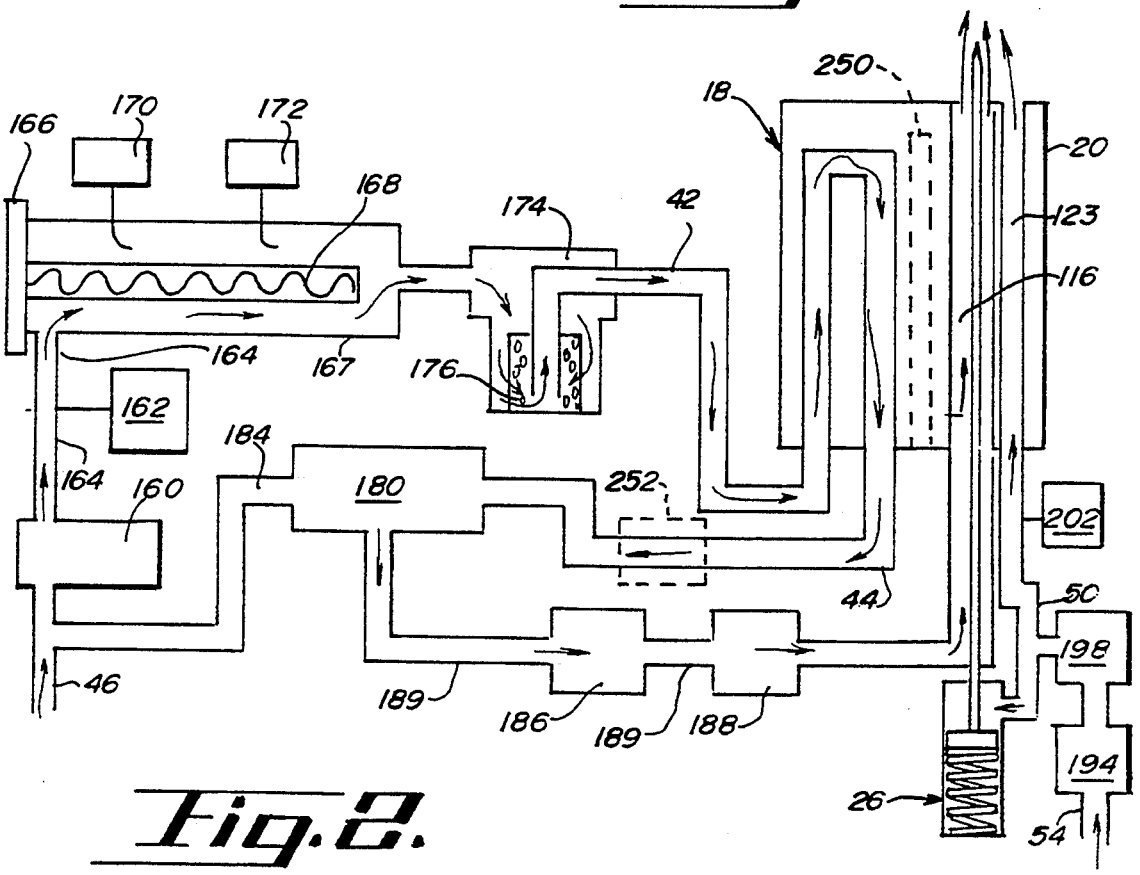
FIG. 2 shows a schematic representation of the hydraulic and pneumatic system of the present invention.

Hydraulic system 12 and pneumatic system 16 can be understood in greater detail by reference to the schematic diagram thereof in FIG. 2. System 12 includes an oil pump 160 in fluid communication with an oil reservoir, not shown, by conduit 46 and with an oil pressure sensor 162 by a conduit 164. Conduit 164 also provides for fluid communication from sensor 162 to an oil heater 166. Heater 166 includes an outer housing 167 within which oil is supplied by connection with conduit 164. An oil heating element 168 is also enclosed within housing 167. An oil temperature control switch 170 and an oil temperature proving switch 172 are in fluid communication with the oil within housing 167, and housing 167 is in fluid communication with an oil filter unit 174. Unit 174 contains an oil filter element 176 of the automotive type and is in fluid communication with atomizing gun body 20 by circulating oil supply conduit 42 connected to circulating oil flow passage 110*a*. Gun body 20 is in turn in fluid communication with a relief valve 180 by return conduit 44 connected to and extending between valve 180 and circulating oil flow passage 110*b* of gun body 20. Valve 180 is fluidly connected to supply conduit 46 by a conduit 184 extending there between. The relief port of valve 180 is connected to a solenoid valve 186, and valve 186 is, in turn, in fluid communication with a regulator valve 188. Combustion oil delivery conduit 48 provides for fluid communication of oil for combustion from valve 188 to combustion oil delivery passage 116.

Compressed air is supplied by conduit line 54 to air filter 194. Filter 194, is, in turn, connected by line 54 to a solenoid valve 198. A line 50 provides for air communication from valve 198 to opening 134 of actuator 26 and to atomizing air delivery channel 123 of gun body 20. An air pressure sensing switch 202 is connected to and senses the pressure in line 50.

Figure 3:
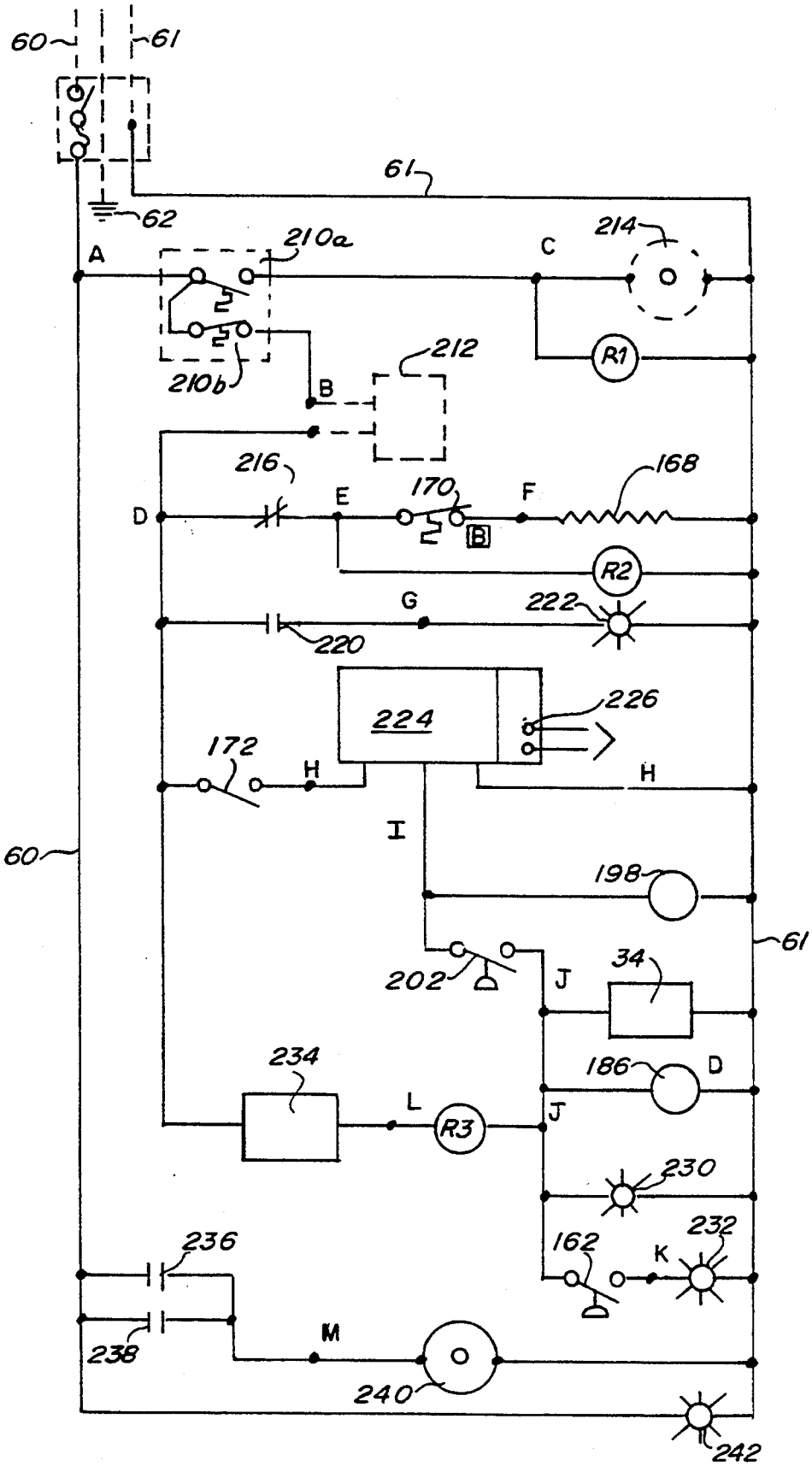
FIG. 3 shows a schematic representation of the control system of the present invention.

The control system 14 of the present invention is seen in schematic form in FIG. 3, wherein line 60 will be understood to be the power carrying line of an alternating current source, and line 61 will be understood to be the common or return line of that current source. To facilitate an understanding of the operation of control system 14 certain components, not a part of the present invention, are included in FIG. 3 and are indicated in dashed lines. Also, control system 14 includes three relays R1, R2, and R3 indicated as such in the circuitry to show their point of power connection. However, to simplify the schematic representation of system 14, the contact switches operated by the various relays are shown at the points in the circuitry over which control of the circuit is exerted by the relays, without showing the particular electrical connections there between.

A line A provides current to a circulating air fan high limit switch 210 which includes a thermostatically controlled normally open switch 210*a* and a normally closed thermostatically controlled safety high limit switch 210*b*, and is in turn connected by a line B to a thermostat 212 and to a line C. Line C provides current to a relay R1 connected in parallel with a circulating air fan motor 214. A line D provides current from thermostat 212 to a normally closed switch 216 of relay R3. A line E connects normally closed switch 216 to thermostatically controlled switch 170, and to relay R2. Switch 170 is normally closed and designed to open at temperatures above 230 degrees Fahrenheit. A line F provides connection between switch 170 and electrical element 168 of heater 166. Line D is also connected to normally open switch 220 of relay R3 and from switch 220 to a line G. Line G provides power to a red warning indicating light 222. Line D is further connected to temperature interlock switch 172, which is in turn connected to a combustion control 224 by a line H. Control 224 is connected to flame sensor 36 by terminals 226 and to line 61 by line H. Control 224 is also connected by a line I to solenoid valve 198 and air pressure switch 202. Switch 202 is connected to a line J, which line J, provides current in a parallel manner to ignition electrodes 34, combustion oil solenoid valve 186, a green operating indicating light 230, and oil filter pressure switch 162. Switch 162 is connected by a line K to an amber dirty filter indicating light 232, and in turn to line 61. Returning again to line D, line D also provides current to a timed make relay 234 which relay is connected by a line L to relay R3. Relay R3 seeks its ground by connection to line J. Line 60 provides power to normally open switches 236 and 238 operated by relays R1 and R2 respectively, and which switches are connected in parallel to a line M. Line M provides current to a combustion motor 240. It will be understood that motor 240 serves to operate combustion air blower 28 and oil pump 128. Line 60 also provides power to a white current indicating light 242.

The operation of the present invention can be appreciated wherein thermostat 212 provides current to line D upon sensing a need for heat. As is conventional in the art, current will be supplied to thermostat 212 through high limit switch 210*b*. Power will then be supplied through switch 216 to relay R2. Relay R2, then closes switch 238 causing motor 240 to run, thus operating pump 160 and combustion air blower 28. It can be appreciated that the oil will then flow in a circulatory manner, as best seen by referring to FIG. 2, from pump 160 through heater 166, through filter 174 into channels 110*a–c* of body 20 of atomizing gun 18, and returned from gun 18 through line 48 to valve 180 and ultimately back again to pump 160 to again pass through the same circulatory loop. Simultaneously with the running of pump 160, current is supplied to heating element 168 of heater 166 through switch 170, assuming the temperature of the oil being below 230 degrees Fahrenheit. It can now be understood that the oil is continuously circulated as it is being heated, which also provides for the convection heating of gun body 20 and nozzle 22 by the flow of the heated oil within body portion 20. The filter 174 being located downstream with respect to the direction of oil flow from heater 166 serves to pickup any particles that may be produced around the immediate vicinity of the heater as the result of heating of the oil. This strategy guards against blockage of the fine combustion oil passages in nozzle 20 of such particles to the extent that any such may occur despite the continual circulation of the oil past heater 166. Upon sensing that the oil has reached a temperature suitable for combustion, approximately 180 degrees Fahrenheit, switch 172 closes and provides current to combustion control 224. Combustion control 224, providing no flame is sensed by photo sensitive sensor 36, then directs current to line I. Air solenoid valve 198 is first energized thus providing pressurized air to line 50. Air is further simultaneously directed to linear actuator 26 whereby the action of the air on piston 127 against spring 126 results in movement of rods 128 and 130 in the direction of the arrow as indicated in FIG. 8, and thus, the retraction of needle 132 from insert channel 80 as is represented in FIG. 10. In addition, pressure sensor switch 202 closes when suitable air pressure is reached thereby allowing current flow to oil solenoid 186. Oil is then diverted from the circulatory loop through regulatory valve 188 to gum body 20 to be sprayed out of orifice 76 into a suitable combustion chamber. In particular, referring to FIG. 10, the retraction of needle 132 permits oil to flow into passage 116 and then along passage 117. The oil then passes, in order, through short tube 136 into space 141, through nozzle body oil channel 100 into oil space 93, through internal fitting oil delivery channel 84 into insert channel 80 to ultimately be ejected from nozzle injection aperture 76. Essentially simultaneously with the direction of oil for combustion as just described, pressurized air is also directed to gun 18 to provide for atomization of the oil injected into the combustion chamber. Specifically, pressurized air is directed to passage 123 and flows there along and through passage portion 123*a* into air space 150 created between shoulder 120 and nozzle base end 98. The air then flows through nozzle body channel 101 into air space 94, and from space 94 through channels 94*a* into channels 78 to ultimately mix in a swirling manner with the oil upon injection thereof into the combustion chamber. Also simultaneously, ignition electrodes are energized resulting in ignition of the air/oil mixture. It will be understood by those of skill, that as oil is burned it will be replaced by the uptake thereof by pump 160 through conduit 46 connected to a suitable tank or reservoir supply.

When a suitable temperature is reached in the combustion chamber switch 210*a* is closed and circulating fan 214 is energized resulting in the direction of air to the space being heated. When thermostat 212 detects the desired heat increase, power to line D is interrupted and all of the various components, sensors, and so forth, deriving power directly or indirectly therefrom, are shut off. In particular, heater 166 is tuned off, air pressure is removed from actuator 26 causing needle 132 to be re-inserted into channel 80, and solenoid valve 186 closes stopping the diversion of oil for combustion from the circulatory loop to gun 18. As a result thereof combustion of oil ceases.

However, it will be understood that switch 210*a* will continue to be closed for a period of time after the shut-down of combustion due to the residual heat in the combustion chamber which needs to be removed therefrom by the action of fan 214. It can now be seen that relay R1 being in parallel connection with fan 214 will continue to be energized after shut-down thereby keeping switch 238 closed. Power will then continue to be supplied to motor 240 during this cool down of the combustion chamber. As a result thereof, pump 160 will continue to operate. Thus, oil will continue to circulate in the circulatory loop, and, as heater 166 is off, this circulation will provide for cooling of gun body, and by convection, nozzle 22. This cooling is needed to prevent the thickening or coagulating of residual oil in gun body 20 and nozzle 22 that can occur as the result of the heat soak thereof from the heat remaining in the combustion chamber after shut-down.

It can now be appreciated that the control system of the present invention provides for four operational stages that can be designated as; off; circulatory oil pre-heating; oil-burn; and post-burn cool down.

An important safety aspect of the present invention can be seen with respect to timed make relay 234 and relay R3. Connection of relays 234 and R3 in series to line D and then to line J results in current being initially supplied thereto when thermostat 212 calls for heat. However, at this initial point line J will not be energized as the oil must first be raised to a suitable combustion temperature prior to which switch 172 will be open, and therefore, no current will be supplied to control 224 and ultimately to line J. As relays 234 and R3 require very little current, electrodes 36 and valve 186 will provide adequate ground for their operation. However, relay 234 is set for a time period of five minutes during which it will not provide current to relay R3. If within this five minute period switch 172 energizes control 224 and the ignition sequence is started and it can be seen that line J will be energized and reach the same potential as line D. As a result thereof, relay 234 will cease to operate, as no net current will flow there through due to this equal potential of lines D and J. If however, this five minute interval expires without line J being energized relay R3 will receive current causing switch 216 to open and switch 220 to close. Thus, heater 168 will be shut off and relay R2 will lose power causing switch 238 to open, turning off motor 240, and providing current to warning indicator light 222. It will be appreciated by those of skill that relays 234 and R3 provide a safety control in the situation wherein ignition does not occur and it may be desirable to stop the operation of pump 160 and heater 166. For example, a rupture in the circulatory loop could result in no ignition, and thus, a shut down of lines I and J by control 224. However, if pump 160 and heater 166 were allowed to continue operating a potentially dangerous or damaging situation could result from a flow of oil from the system.

A further feature of the present invention concerns the maintenance of the oil at a pressure of approximately 20 psi in the circulatory system and in the combustion oil circuit. This pressure is accomplished by valves 180 and 188 respectively, and serves to maintain the oil at such pressure until it exits orifice 76. In this manner, gassing-off of the oil is prevented. The gasses produced by waste oil are typically not capable of supporting combustion and often cause unwanted flame outage.

Another feature of the present invention concerns the modified atomizing gun 18 wherein needle 132 is provided to allow for mechanical cleaning of the nozzle assembly thereof after each heating cycle as a result of the repeated linear movement thereof. Thus, any blockage that may occur, particularly in the small orifices and passages in nozzle 22, will be removed by such action. In addition, needle 132 provides for a safety closing of channel 80 at shut-down so that oil will not flow from nozzle 22 unless combustion is occurring. It can be appreciated that nozzle body 90 has been particularly designed to provide for the proper guiding of needle 132 there through and into insert 70. In addition, the interaction of nozzle body 90, tube 136 and gun body 20, allow for such use of a needle 132 in nozzle 22 while providing for the isolation of combustion oil from the atomizing air up to the point just prior to injection.

An important feature of the present invention concerns the construction of gun body 20. The various air and oil delivery and combustion channels consist of bores that have been drilled into an originally solid block of aluminum. This construction provides for a gun body that is relatively inexpensive to manufacture, that is highly reliable, and minimizes the number of separate elements needed to form the entire gun 18.

Figure 6:
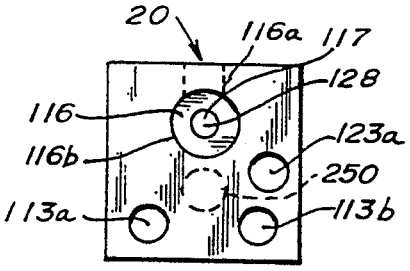
FIG. 6 shows an end view of the atomizing gun body along lines 6—6 of FIG. 4.
Figure 7:
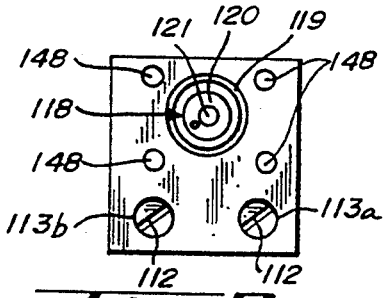
FIG. 7 shows an end view of the atomizing gun body along lines 7—7 of FIG. 4.

In an alternative embodiment of the present invention heating of the oil can also be accomplished in lieu of heater 166 with a heater 250 located in gun body 20. Specifically, heater 250 is inserted in block 20 centrally thereof and substantially along the entire length thereof, as indicated in outline in FIGS. 2 and 3, and as seen in FIG. 6. Thus, heater 250 provides for heating of the oil as it is being circulated by conduction thereto through gun body 20. Since the filtration desirably occurs downstream of the heater an alternate location thereof is indicated. As seen by referring to FIGS. 21 and 22, a vapor eliminator 251 is combined with a filter element 252 and is located downstream of heater 250. Thus, filter 252, identical with filter 174 and used in place thereof, is located, for example, on conduit 44 to provide for the downstream positioning. A complete description of the structure and function of vapor eliminator 251 and filter 252 combination is contained herein below. It will be understood by those of skill in the art that switches 170 and 172 would, in this alternate embodiment, be located for example in equivalent positions in conduit 164. This heater positioning can provide for quicker heating of gun 18 and for a somewhat more compact arrangement of the components of the present invention.

It can also be seen that the continual circulating of the oil during heating thereof reduces the chances of localized over-heating of the oil. Thus, damaging particulate matter production or agglomerate formation is reduced. In addition, pressure indicating switch 162 is provided to check the pressure in the circulatory system. A high pressure in excess of 35–50 psi indicates that filter element 176 is filled with particulate matter and should be changed. The connection of pressure switch to line K insures that switch 162 is not activated unless the oil has first been heated. Otherwise, switch 162 would give false signals by activating light 232 as the cold oil at start-up would give an initially high pressure reading that would not be properly indicative of a dirty filter.

Air filter 194 provides for cleaning of the air delivered to actuator 26 and gun 18 to reduce any contamination thereof. Air regulator valve 198 provides for the regulating of the delivered air pressure to allow for various operating parameters. In a similar manner, and in coordination therewith, oil pressure regulator valve 188 can provide for the regulation of oil pressure in the circulatory and combustion circuits to allow for tuning the present invention for particular operating conditions, such as rate of burn and the particular condition of the oil being combusted.

A further embodiment of the atomizing gun of the present invention is seen in FIGS. 14–19. Gun 300 has a tubular housing 302, defining an interior space 303, and tube 302 is secured on end thereof to a delivery block 304. A nozzle 306 extends from the opposite end of tube 302. Within housing 302 a tube 308 extends for slideably retaining a heating element 310. Tube 308 is secured within a channel 312 extending through block 304, and on the opposite end thereof has a closed end 314.

A U-shaped heating oil circulating tube 316 is secured to channels 318*a* and 318*b* of block 304. Channels 318*a* and 318*b* extend horizontally partially through block 304 and intersect with vertical circulating oil channels 320*a* and 320*b* respectively. Circulating oil is delivered to channels 320*a* and 320*b* by tubes 321*a* and 321*b* respectively. Tubes 321*a* and 321*b* are secured to blocks with threaded fittings 322. A temperature sensor 324*a* is secured to block 304 and communicates with channel 320*a*, and a temperature sensor 324*b* is secured to block 304 and communicates with channel 320*b*. Sensors 324*a* and 324*b* are equivalent with sensors 170 and 172 respectively.

A combustion air delivery tube 325 is retained in an air channel 326 of block 304 and on the opposite end thereof is secured to nozzle 306. Channel 326 extends partially into block 304 and intersects transversely with a further air delivery channel 328. Channel 328 is, in turn, in fluid communication with a valve cavity 330 which is in fluid communication with a vertically extending air channel 332. Combustion air is provided to channel 332 by a air conduit or hose 333. Conduit 333 is secured to block 304 by a fitting 334 threadably engaged therewith. A solenoid valve 335 is secured to the exterior of block 304 and includes a valve actuating member 336 having a resilient sealing end portion 337. End portion 337 operates to seal against a seat 338 extending around orifice 339 by operation of member 336. A channel 340 intersects channel 328 and retains an air pressure sensing switch 342.

A combustion oil delivery tube 344 is retained in an oil channel 346 of block 304 and on the opposite end thereof is secured to nozzle 306. Channel 346 extends partially into block 304 and intersects transversely with a further oil delivery channel 348. Channel 348 is in turn in fluid communication with a valve cavity 350 which is in fluid communication with a vertically extending oil channel 352. Combustion oil is provided to channel 352 by a tube 353. Tube 353 is secured to block 304 by a fitting 354 threadably engaged therewith. A solenoid valve 355 is secured to the exterior of block 304 and includes a valve actuating member 356 having a resilient sealing end portion 358. End portion 358 operates to seal against seat 360 extending around orifice 362 by operation of member 336. A rod 364 extends through tube 344 and includes a needle end 366 for inserting into orifice 368 of nozzle 306. A pneumatic linear actuator 370 is secured to block 304 and provides for the operation of rod 364. Actuator 370 is connected to and operated by the pressurized air delivered along line 333, which air also operates valve 335. A channel 372 extends into block 304 and is in fluid communication with channel 348 and serves to retain an oil pressure sensor 374. In the preferred form of the present invention, the interior area 303 of tube 302 is filled with a heat conductive material after tubes 308, 316, 325 and 344 have been brazed or soldered in place therein to block 304. In particular, area 303 is filled with a molten aluminum 303 which, of course, hardens to form the heat conductive filling material. Outer housing tube 302 as well as the various tubes internal thereof and block 304 are preferably made of steel.

Figure 15:
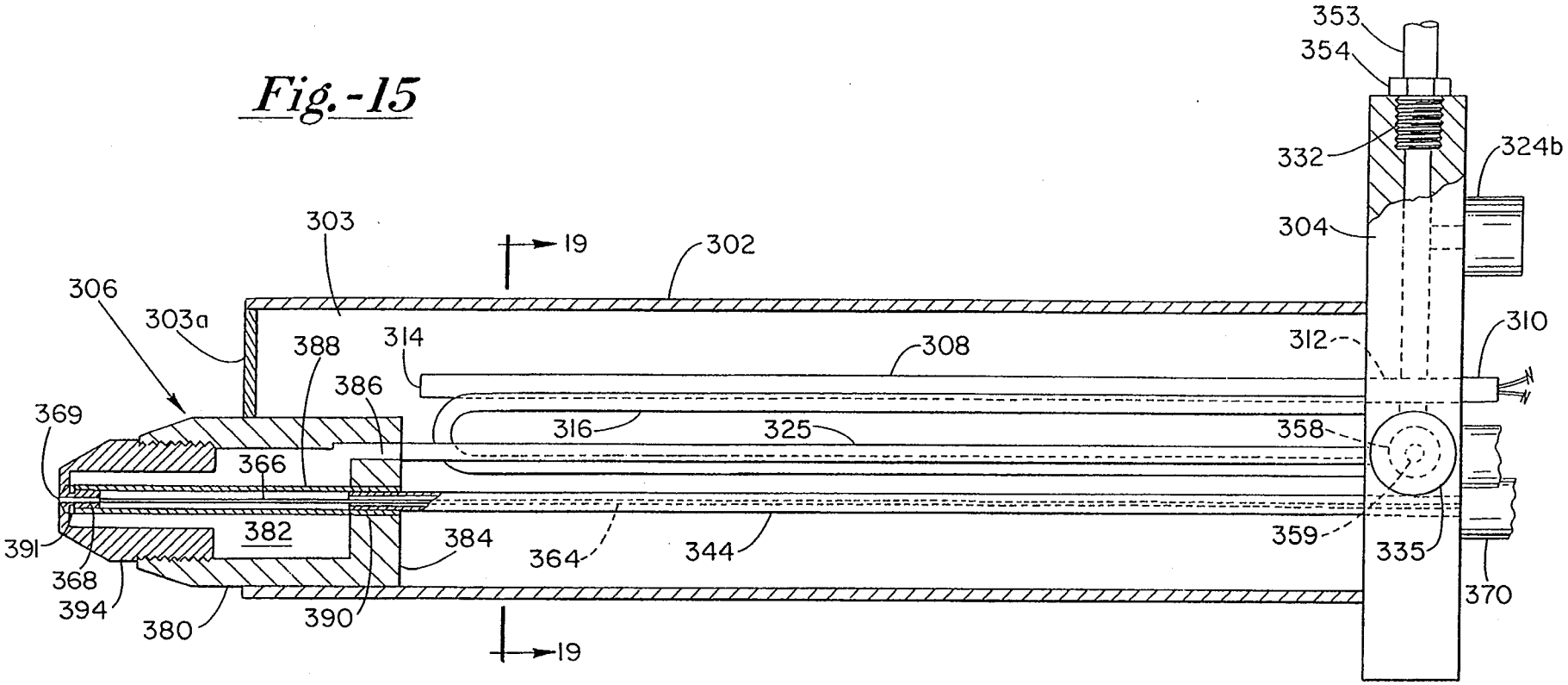
FIG. 15 shows a side plan view of the gun of FIG. 14 with the tubular housing cut away and a partial cross-section of the nozzle thereof and the delivery block.
Figure 16:
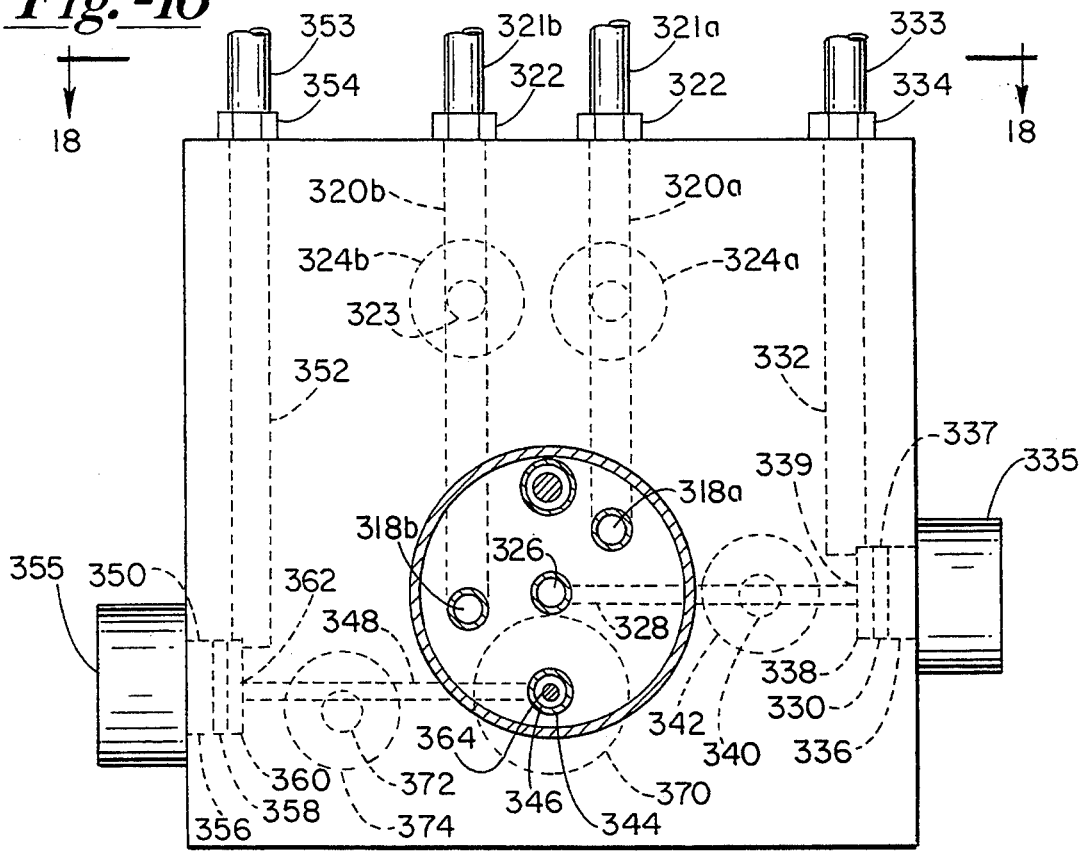
FIG. 16 shows a cross-sectional view along lines 16—16 of FIG. 14.
Figure 17:
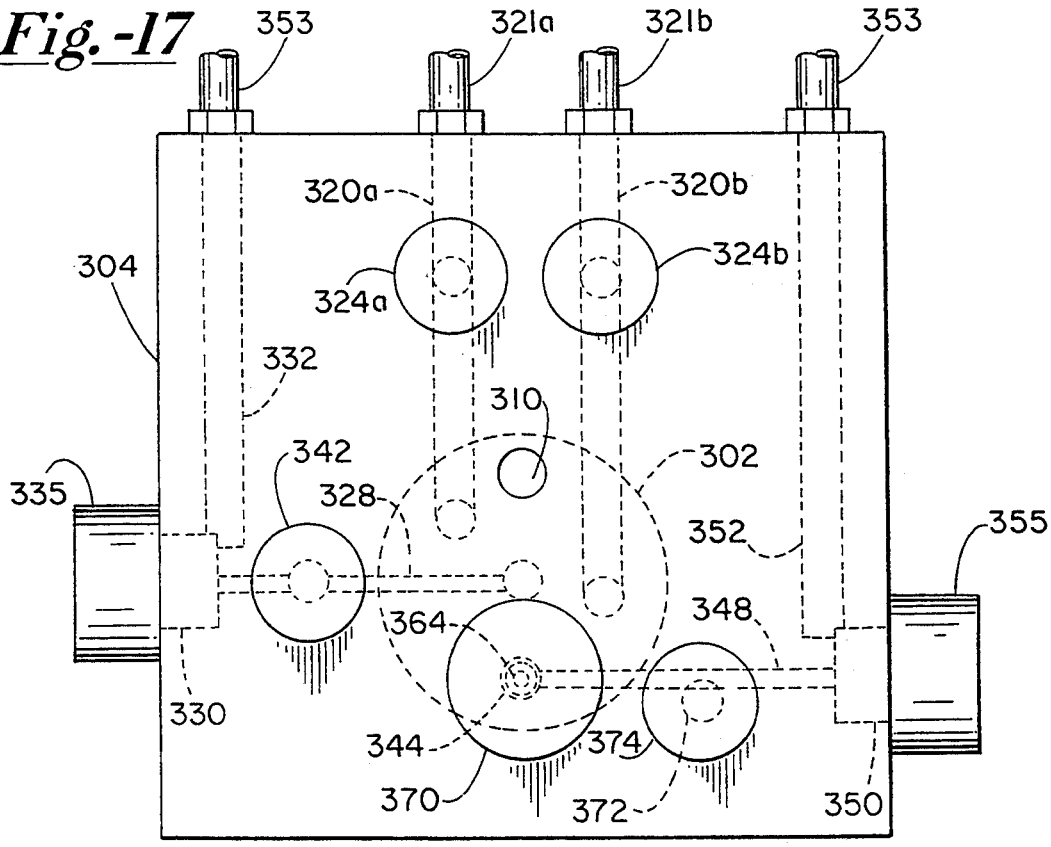
FIG. 17 shows an end view along lines 17—17 of FIG. 14.

As seen in FIG. 15, nozzle 306 includes a first portion 380 having an air cavity 382. An end 384 of portion 382 includes a hole 386 there through for receiving and retaining air delivery tube 325. A further combustion oil tube 388 is retained in a hole 390 and is sized to receive and retain combustion oil tube 344. Tube 388 extends through cavity 382 and retains in an opposite end thereof an air and oil mixing insert 390 and aluminum washer 391. A nozzle end piece 394 is threadably engaged with nozzle portion 380 and serves to provide the force to seat and retain insert 390 against washer 391 and, in turn, against tube 388. Also, as is known in the art, nozzle end piece 394 serves to substantially close cavity 382 except for the air that is permitted to mix with the combustion oil at insert 392 just prior to ejection through orifice 368. Thus, nozzle 306 is less prone to air leakage as the result of faulty o-rings as tube 388 is brazed or soldered to nozzle portion 380, and as aluminum washer 391 is relatively soft compared to tube 388 or insert 392. In addition, tubes 308, 316, 325 and 344 are brazed or soldered to block 304 and tubes 325 and 344 are so connected to nozzle portion 380.

Figure 20:
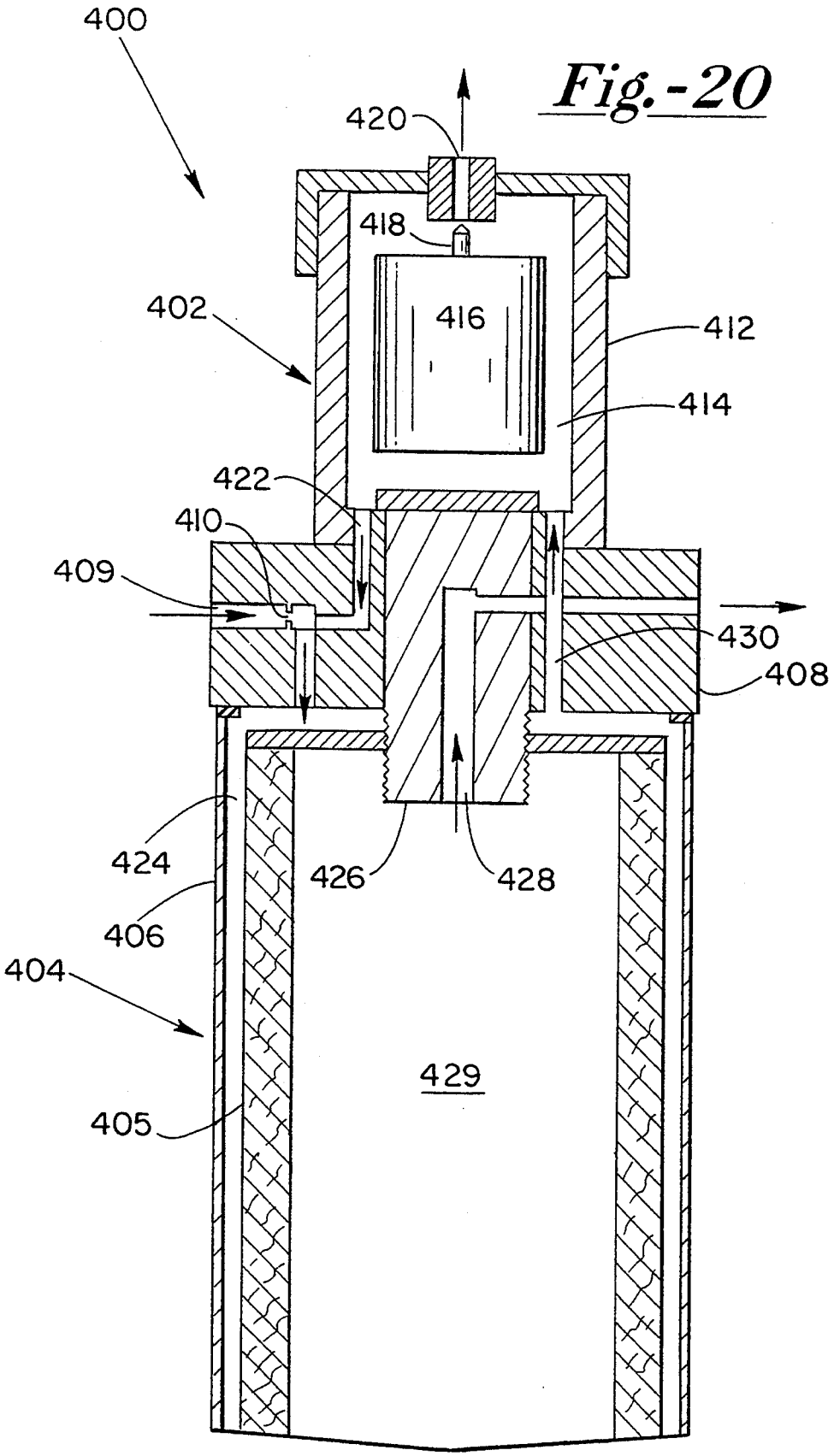
FIG. 20 shows a cross-sectional view of the vapor eliminator/filter of the present invention.

A vapor eliminator-filter device is seen in FIG. 20 and generally designated by the numeral 400. Device 400 includes a vapor eliminator 402 and a filter 404 having an inner tubular element 405 and an outer housing 406. Filter 404 is preferably of the automotive type well known in the art. Filter 404 is threadably secured to a block 408. Block 408 includes an oil inlet channel 409 connected to oil line 44 and includes a venturi 410. A float chamber housing 412 is secured to block 408 and defines and interior space 414 that retains a float 416. Float 416 includes a pin 418 that seats in vent aperture 420. Block 408 also includes a float chamber outlet channel 422 that is in fluid communication with channel 409 and terminates within filter housing 406 in a space 424 between housing 406 and filter element 405. A central threaded portion 426 of block 408 includes an outlet channel 428 providing for fluid communication from the center space 429 of filter 405 back to oil line 44. Block 308 also includes a float chamber inlet channel 430 that provides fluid communication between space 424 above element 405 and float chamber 414.

The operation of device 400 can be understood wherein oil will flow from line 44 into channel 409, through venturi 410 and into space 424. The oil will then pass through element 405 and then into channel 428 and back to line 44. Also, venturi 410 creates an area of reduced pressure immediately downstream thereof, thus, a suction is created in a direction from chamber 414 through channel 422 to space 424. Conversely, a suction is created through channel 430 in a direction from space 424 to chamber 414. Therefore, any gas that has released from the oil will accumulate at the top of space 424 and flow through channel 430 into chamber 414 causing float 416 to drop, unseating pin 418 so that the air can be vented out aperture 20.

Figure 21:
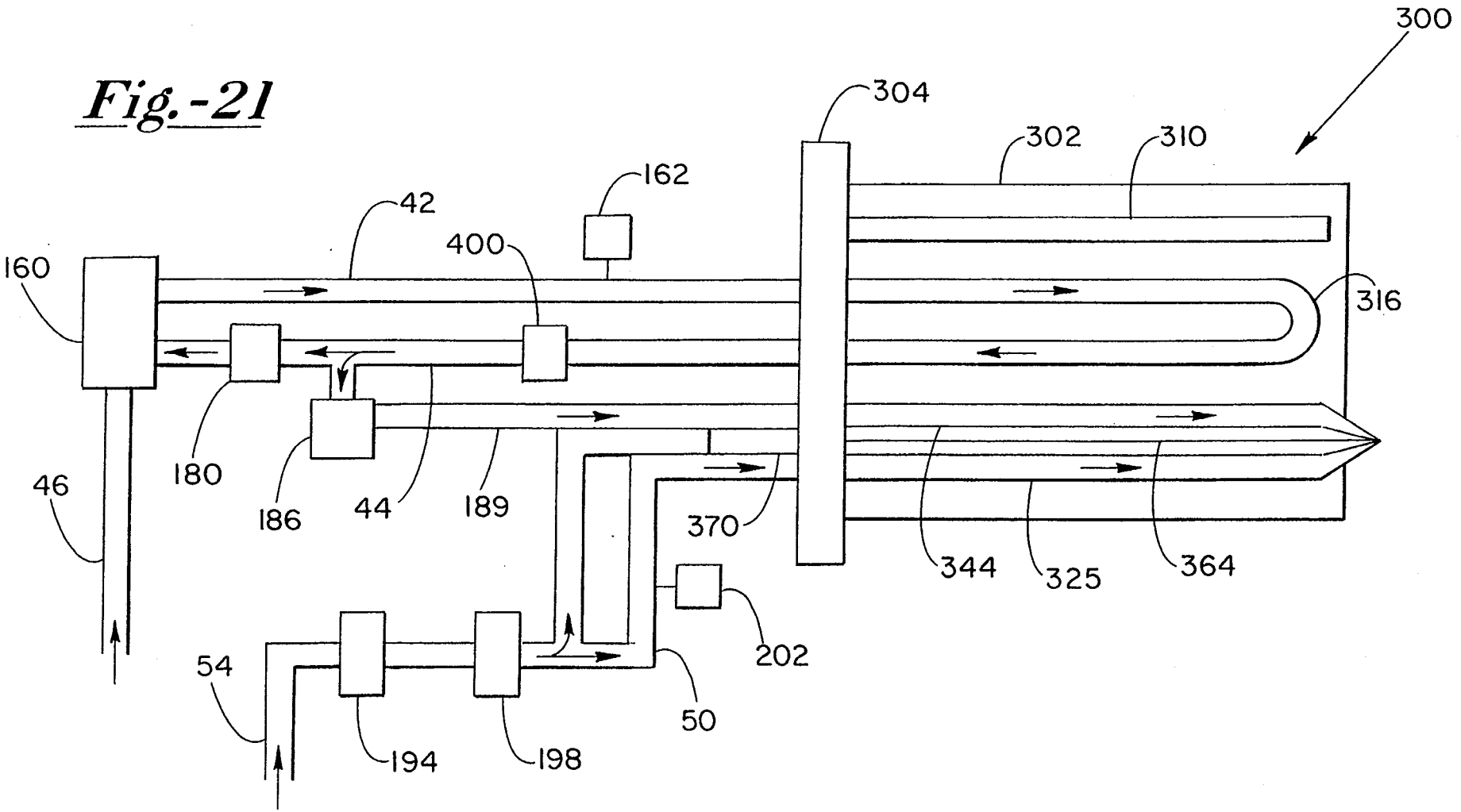
FIG. 21 shows a schematic view of an alternate embodiment of the hydraulic and pneumatic circuits of the present invention.

It will be understood that gun 300 operates essentially in the same manner as previously described herein with respect to gun 18 in conjunction with hydraulic system 12, control system 14 and pneumatic system 16. In particular, at start-up, gun 300 is pre-heated by the operation of heater element 310 and the circulating of heated oil through circulating tube 316. As with gun 18, use of heater 310 would ideally involve the use of a filter 252 in the position as indicated in FIG. 2., or as shown in FIG. 21. In addition, so that the connection of gun 300 with the hydraulic and pneumatic lines represented in FIG. 2 can be understood, circulating lines 321*a* and 321*b* are equivalent with lines 42 and 44 respectively and lines 333 and 353 are equivalent with lines 50 and 189 respectively. Once a sufficient heat is sensed, as through sensors 172 or 324, valve 335 is operated to open, retracting seal 337 from seat 338 and permitting pressurized air to travel through channels 328 and 326 and into tube 325 for delivery to nozzle 306. Simultaneously, line 333 delivers air to actuator 370 retracting rod needle end 366 from orifice 368. Air pressure sensor switch 342 upon sensing sufficient air pressure operates valve 355 permitting oil to flow from channel 352 through channels 348 and 346 and into tube 344 for ultimate delivery to nozzle 306. Thus, the air and oil can be injected by nozzle into a suitable combustion chamber for ignition and combustion therein.

It can be appreciated that gun 300 has advantages of low cost, with respect to materials required and ease of construction. In addition block 304 provides an efficient and relatively compact means for routing the circulating oil, combustion air and combustion oil. Also, block 304 by consolidating all such oil and pneumatic lines and the use of threaded fittings, provides for easy removal of gun 300 from the combustion chamber for inspection and cleaning thereof.

Figure 22:
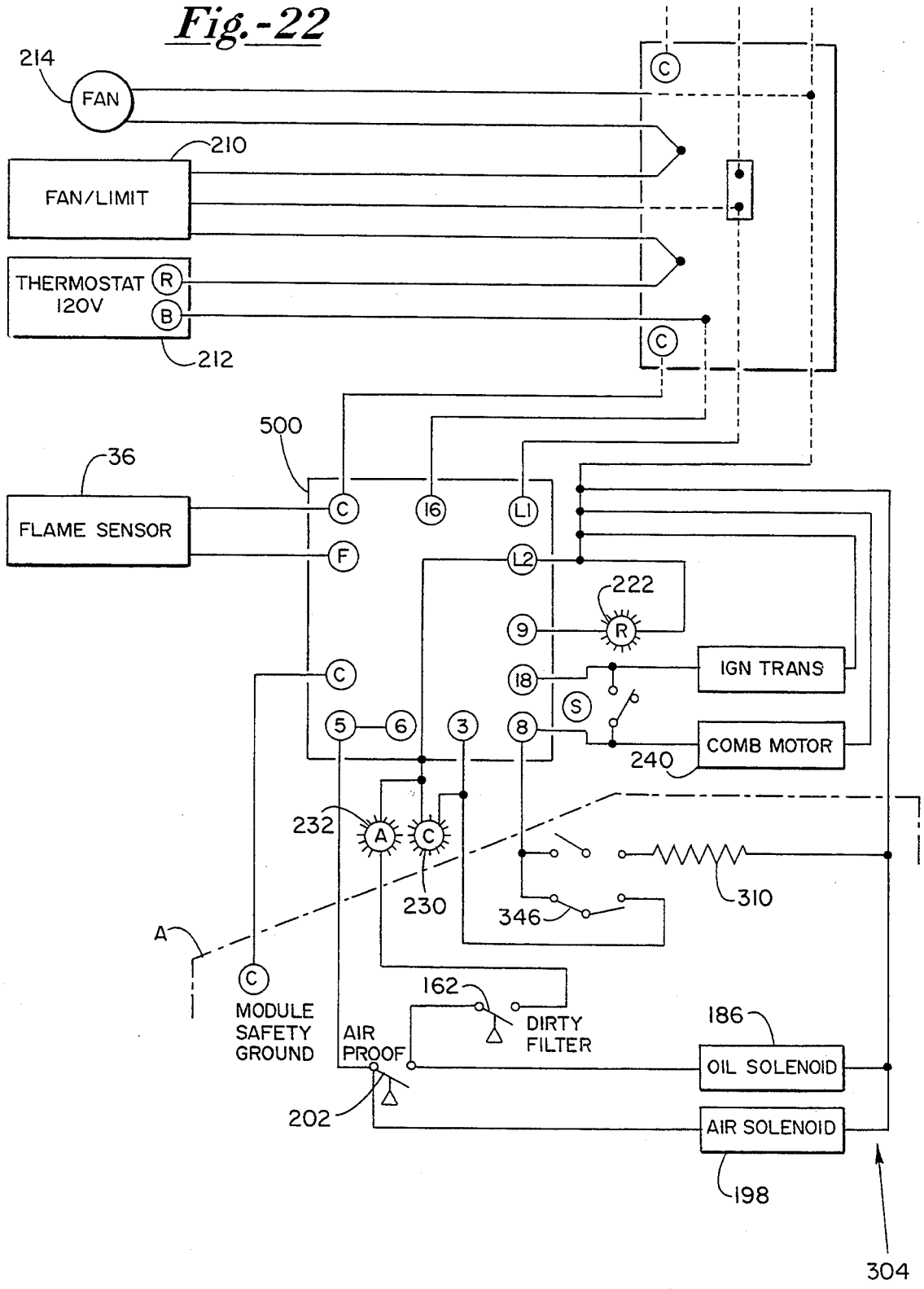
FIG. 22 shows and alternate embodiment of the control circuit of the present invention.

The present invention can also use an oil furnace combustion control mechanism of the type manufactured by Honeywell Inc., Minneapolis, Minn. and designated Model No. 7795C. A further schematic diagram of the control circuitry of the present invention wherein this Honeywell control is used is seen in FIG. 22. As seen therein, such control, is generally designated 500, to which power is supplied for the electronic thereof along line L1. The power for running of the combustion motor 240 and so forth is provided along line 16. Control 500 has the operating sequence of: off; 90 second purge; self electronic check; 10 second trial for ignition; flame established for continuous burning; terminate spark ignition after flame detection; 4-second to terminate oil flow after flame loss; automatic 90 second purge of combustion chamber; re-check electronics; a second 10 second trial for ignition; and a full safety shutdown if a flame is not reestablished by the second 10 second trial for ignition. Thus control 500 provides for functions equivalent with those as described above pursuant to FIG. 3. A dashed line A indicates the division between the control and the elements contained on block 304. A further Honeywell combustion control Model No. RM7800E can be used to provide all the above described functions and in addition further control abilities such as the cool-down step previously described herein.

The present invention is contemplated for use in small business locations, such as service stations and the like where waste oil is generated which could then provide for space heating. Thus, the invention herein is currently designed to produce heat in the range of 100,000 to 300,000 BTU's per hour. This size range is particularly as the result of the U.S. Environmental Protection Agency requirement that waste oils not be burned at any one location in excess of 54,000 BTU's per hour due to combustion product dispersal considerations. A 100,00 to 300,000 BTU burning rate would translate into a gallons per hour (GPH) flow rate in the combustion oil circuit of from approximately 1.0 to 3.0 GPH, and a flow rate of approximately 18 GPH in the circulatory loop.

Typically the present invention provides oil for combustion at the rate of 1 gallon per hour whereas the pump may be pumping at the rate of 18 gallons per hour. Thus, 17 gallons per hour are being recirculated to relief valve 180 and back to the inlet of pump 160. However, unlike conventional one or two pipe return or recirculating systems, in the present invention oil is not recirculated until it has passed through the entire circulatory loop including the heater, filter and gun. Thus, the recirculated oil is heated and not returned to a supply tank or simply circulated within the valve. In addition, unlike such systems, as seen by also referring to FIGS. 2 and 21, it can be appreciated that the combustion oil circuit and the circulatory loop will be "seeing" the same pressure, especially wherein, as seen in FIG. 21, pressure regulating valve 188 is eliminated. Valve 188 can be useful if the pressure in the circulating loop gets above a desired operating pressure, which in the present invention is around 20 psi. However, that situation is essentially eliminated in the present invention as the oil is preheated during circulation and prior to combustion, so that, for example, the pump is not having to continually pump a relatively large volume of cold oil from the reservoir tank. In the present invention, "new oil" from the tank is only brought in to the extent oil is diverted from the circulatory loop and burned, which volume is relatively small compared to the total volume circulating. In addition, the relatively higher combustion oil pressure can be tolerated in the present invention as the filter 404 downstream of heater 310 removes particles that would otherwise clog nozzle 306. This situation is as compared to the prior waste oil combustion art wherein it is known by those of skill that typical combustion oil pressures are much lower and in the range of 4 psi. Such pressure range is dictated by the proportionately larger nozzle oil injection orifices that are required due to the strategy in prior art waste oil burners of having the orifice be sufficiently large so that large particles can pass there through. Also, since the oil that is circulated is heated, relief valve 180 does not have to be set for a relatively high pressure, as with prior art pumps as mentioned above, that require the higher setting to pump the colder or unheated oil. In addition, such systems, by virtue of the higher pump operating pressures, require a pressure regulator valve to step down from these higher pressures to the much lower combustion oil pressures. A further problem with conventional pressure regulating valves concerns their difficulty in delivering a steady flow of oil. There exists a tendency for such valves to "hunt" in the low flow rates and low combustion oil pressure ranges associated with prior art waste oil combustion devices whereby the desired set point is overshot and undershot. In the present invention relief valve 180 is working in a pressure and flow range wherein an accurate pressure can be more easily maintained. Thus, oil is provided at an accurate steady flow for combustion thereby allowing for more even burning characteristics and greatly reducing flame-outs that can result from an uneven oil flow.

The higher combustion oil and circulatory oil pressures of the present invention also permit higher velocity flow and less chance of coke particles forming from localized heating of the oil. Moreover, the higher combustion oil pressures herein provide for better oil atomization. Oil filter light 232 indicates that filter 174 or 404 needs replacing when the pressure sensed increases to approximately 35 psi. Of course, valve 180 will keep the pressure to the combustion system at 20 psi, however if the filter is not replaced, eventually there will not be enough oil to support combustion and there will be a flame outage. Control mechanism 400 would then attempt one re-start and then go into full shut down. Thus, the present invention also provides for an additional margin of safety with respect to a non-replaced dirty filter. It can also be appreciated, that at start-up the circulatory loop will be open to atmospheric pressure through the "settling" down of float 416 through the open aperture 420. As a result thereof, pump 160 does not require a bleed outlet, such bleed accomplished automatically by vapor eliminator 400.

Because of maintaining relatively higher of pressure in both the circulatory loop and the combustion circuit along with the constant circulation of the oil, the oil can be heated to a temperature well in excess of its boiling point whereby various viscosity's and/or burning characteristics of the particular fuel can be allowed for. For example, it is contemplated that other types of fuel sources can be utilized by the present invention, such as, vegetable oils. Large quantities of such oils are produced by restaurants, and the like, and, as with petroleum oils, can present a substantial disposal problem. The location of a downstream filter can also serve to permit such higher temperature operating conditions by catching any particles that may form as a result of the heating of the fuel prior to combustion thereof. In addition, pressure regulating valve 188 can be of value to tailor the combustion system to a particular fuel where the combustion oil is required to be, for example, at a pressure substantially lower than that of the circulatory loop.

The present invention has been described herein as including various specific structures. However, it will be apparent to those of skill that various modifications or rearrangements of the described parts can be made without departing from the spirit and scope of the underlying inventive concept. Thus, the present invention is not limited to the particular form or forms shown and described herein, reference is directed to the appended claims for a determination of the scope thereof.

What is claimed is:

1. A vapor eliminating device for eliminating gaseous components from a circulating liquid, comprising:

a center block having a float housing secured to a top surface thereof defining a float chamber, and a second housing secured to a bottom surface thereof defining a second interior, and the second housing interior having a filter element therein, the filter element separating the second housing into an space interior of the filter element and an annular space between the filter element and the second housing, and the block also having a first liquid flow channel and a second liquid flow channel therein, each liquid flow channel providing for separate fluid communication between the float chamber and the annular space of the second housing, the block also having a liquid flow inlet channel and a liquid flow outlet channel, the inlet channel connected to a liquid inlet line for providing supply of the circulating liquid to the first flow channel, and the inlet channel having venturi means for providing a suction immediately downstream thereof in the first flow channel so that a circulation of the liquid is created from the float chamber to the annular space through the first flow channel and from the annular space back to the float chamber through the second flow channel, the float chamber having a float therein and the float having means for releasably sealing with aperture means in the float housing as a function of the amount of liquid in the float chamber so that any gas trapped in the float chamber can be released through the aperture when a relatively low volume of liquid is held within the float chamber and so that the aperture is closed when a relatively high volume of liquid is held within the float chamber, and the liquid outlet channel providing for fluid communication of the liquid from the interior space to a fluid outlet line.

2. The device as defined in claim 1, and the second housing and filter element forming a single unit and threadably securable to the center block.

3. A vapor eliminating device for eliminating gaseous components from a circulating heated oil, comprising:

a center block having a float housing secured to a top surface thereof defining a float chamber, and a second housing secured to a bottom surface of the center block defining a second interior, and the second housing interior having a filter element therein, the filter element separating the second housing into an interior space interior of the filter element and an annular space between the filter element and the second housing, and the block also having a first oil flow channel and a second oil flow channel therein, each oil flow channel providing for separate fluid communication between the float chamber and the annular space of the second housing, the block also having an oil flow inlet channel and an oil flow outlet channel, the inlet channel connected to an oil inlet line for providing supply of the circulating oil to the first flow channel, and the inlet channel having venturi means for providing a suction immediately downstream thereof in the first flow channel so that a circulation of the oil is created from the float chamber to the annular space through the first flow channel and from the annular space back to the float chamber through the second flow channel, the float chamber having a float therein and the float having means for releasably sealing with aperture means in the float housing as a function of the amount of oil in the float chamber so that any gas trapped in the float chamber can be released through the aperture when a relatively low volume of oil is held within the float chamber and so that the aperture is closed when a relatively high volume of oil is held within the float chamber, and the oil outlet channel providing for fluid communication of the oil from the interior space to a fluid outlet line.

4. The device as defined in claim 3, and the second housing and filter element forming a single unit and threadably securable to the center block.

* * * * *